US006170769B1

(12) United States Patent
Bergdahl et al.

(10) Patent No.: US 6,170,769 B1
(45) Date of Patent: Jan. 9, 2001

(54) SCREENING APPARATUS WITH REJECT FLOW RESTRICTION MEANS

(75) Inventors: Anders Bergdahl; Kjell Forslund, both of Sundsbruk; Lennart Svensson; Björn Wikström, both of Sundsvall, all of (SE)

(73) Assignee: Valmet Fibertech Aktiebolag (CH)

( * ) Notice: Under 35 U.S.C. 154(b), the term of this patent shall be extended for 0 days.

(21) Appl. No.: 09/402,915

(22) PCT Filed: Apr. 8, 1998

(86) PCT No.: PCT/SE98/00651

§ 371 Date: Oct. 13, 1999

§ 102(e) Date: Oct. 13, 1999

(87) PCT Pub. No.: WO98/46822

PCT Pub. Date: Oct. 22, 1998

(30) Foreign Application Priority Data

Apr. 14, 1997 (SE) ..... 9701369

(51) Int. Cl.[7] ..... B02C 13/18

(52) U.S. Cl. ..... 241/46.17; 209/273; 241/74

(58) Field of Search ..... 241/46.17, 74, 241/81; 209/273, 389

(56) References Cited

U.S. PATENT DOCUMENTS 3,713,595 * 1/1973 Craig et al. ..... 241/46.17
4,699,324 10/1987 Ahs .
4,911,828 3/1990 Musselmann et al. .
5,096,127 * 3/1992 Young ..... 241/74

* cited by examiner

*Primary Examiner*—Mark Rosenbaum
(74) *Attorney, Agent, or Firm*—Lerner, David, Littenberg, Krumholz & Mentlik, LLP

(57) ABSTRACT

Screening apparatus is disclosed for separating fiber suspensions including a housing having an inlet for the fiber suspension, a stationary tubular screen having an inlet end adjacent to the housing inlet and an outlet end, and dividing the interior of the housing into a central chamber for receiving the fiber suspension from the inlet, and an outer accept chamber for receiving an accept fraction of the fiber suspension, a rotor journalled on the housing for rotation within the central chamber coaxially with the stationary tubular screen, a reject passage for receiving a reject portion of the fiber suspension at the outlet end of the stationary tubular screen, and an annular reject passage which has a radial width and a cross-sectional area at the outlet end of the stationary tubular screen for discharging the reject portion of the fiber suspension from the central chamber to the reject passage, the annular reject passage including an annular flange attached to the inner wall of the passage, resilient tubing disposed in the annular groove connectable to a source of pressure whereby the resilient tubing can be extended and contracted and an elastic ring surrounding the resilient tubing.

9 Claims, 1 Drawing Sheet

SCREENING APPARATUS WITH REJECT FLOW RESTRICTION MEANS

FIELD OF THE INVENTION

The present invention relates to a screening apparatus for separating fiber suspensions, comprising a housing, an inlet to the interior of the housing for a fiber suspension to be separated, a stationary tubular screen dividing the interior of the housing into a central chamber for receiving the fiber suspension from the inlet at one end of the tubular screen and an outer accept chamber for receiving an accept fraction of the fiber suspension, which has passed through the screen, and a rotor journalled on the housing and situated in the central chamber coaxially with the tubular screen. More particularly, the present invention comprises flow restriction means defining an annular reject passage which is coaxial with the tubular screen and situated at the other end thereof for discharging a developed reject fraction of the fiber suspension from the central chamber, the cross-sectional area of the annular reject passage being adjustable by said flow restriction means.

SUMMARY OF THE INVENTION

Apparatus of the above-disclosed type is generally used for separating paper pulp suspensions, such as for fractionating fibers or for separating contaminants and other undesirable particles, such as incompletely treated fibers. A well-known problem in connection with the separation of a pulp suspension by this type of apparatus is that the pulp suspension in the central chamber has a higher fiber concentration relatively close to the reject passage than relatively close to the end of the tubular screen where the pulp suspension to be separated enters the screen. This is due to the fact that the liquid, usually water, in the pulp suspension easily separates through the screen immediately after having entered the tubular screen. As a consequence the developed reject fraction is thickened in the vicinity of the reject passage. This thickening of the reject fraction is further increased if only a relatively small flow of the reject fraction is permitted to escape through the reject passage. Too large a thickening of the reject fraction, on the other hand, gives rise to problems, such as torque transmission between the rotor and the screen in view of the thickened reject fraction, which leads to an increased energy consumption for rotating the rotor. The rotor can possibly also become affixed to the screen, which requires a costly break in production for manual cleaning of the rotor and screen. The thickened reject fraction can also be difficult to discharge through the usually narrow reject passage and further through a valve situated outside of the apparatus.

It has also been established that the thickened reject fraction is insignificantly dissolved by non-thickened pulp suspension. As a consequence such non-thickened, easily flowing pulp suspension can pass thickened, viscous reject fraction and escape through the reject passage, which decreases the separation efficiency of the apparatus.

U.S. Pat. No. 4,699,324 discloses a screening apparatus of the present type, in which the reject passage is defined by an annular inner element mounted coaxially on the rotor and an annular outer element, which is mounted on the stationary screen and surrounds that inner element. These annular elements comprise opposite grinding means, so that during operation, when the inner element moves along the outer element, this grinding means act on the passing reject fraction to effect reduction of shives and other components. According to this patent, the dimensions of the reject passage may be changed by using a rotor, grinding elements and a screen which are all generally conical and axially displacing the conical rotor relative to the conical screen.

The object of the present invention is thus to provide a screening apparatus, which solves the above problems of reject fraction thickening, and in particular which prevents non-thickened fiber suspension from passing thickened reject fraction.

SUMMARY OF THE INVENTION

In accordance with the present invention, these and other objects have now been realized by the invention of a screening apparatus for separating fiber suspensions comprising a housing including an interior and an inlet for the fiber suspension, a stationary tubular screen having an inlet end adjacent to the inlet and an outlet end, and dividing the interior of the housing into a central chamber for receiving the fiber suspension from the inlet and an outer accept chamber for receiving an accept fraction of the fiber suspension which has passed through the stationary tubular screen, a rotor journalled on the housing for rotation within the central chamber coaxially with the stationary tubular screen, a reject passage for receiving a reject portion of the fiber suspension at the outlet end of the stationary tubular screen, and flow restriction means defining an annular reject passage having a radial width and a cross-sectional area at the outlet end of the stationary tubular screen for discharging the reject portion of the fiber suspension from the central chamber to the reject passage, the flow restriction means comprising an expandable and contractable annular member for decreasing and increasing the cross-sectional area of the annular reject passage. In a preferred embodiment, the flow restriction means comprises a stationary inner wall portion and a stationary outer wall portion surrounding the stationary inner wall portion, the annular member being attached to the stationary inner wall portion.

In accordance with one embodiment of the screening apparatus of the present invention, the stationary outer wall portion is connected to the stationary tubular screen.

In accordance with another embodiment of the screening apparatus of the present invention, the stationary inner wall portion is connected to the housing.

In accordance with another embodiment of the screening apparatus of the present invention, the annular member comprises an elastic ring. In a preferred embodiment, the apparatus includes an annular flange attached to the stationary inner wall portion, the annular flange providing an outwardly facing annular groove, resilient tubing disposed in the annular groove, the resilient tubing being connectable to a source of pressure whereby the resilient tubing can be extended and contracted, and an elastic ring surrounding the resilient tubing. In a preferred embodiment, the elastic ring is received by the annular groove and is in a prestressed state when the resilient tubing is contracted.

In accordance with one embodiment of the screening apparatus of the present invention, the radial width of the annular reject passage can vary between about 2 and 25 mm by means of the expansion and contraction of the resilient tubing, and preferably between about 10 and 20 mm.

The object of the present invention is achieved by an apparatus of the type described above, which includes flow restriction means which comprise an annular member, which is expandable and retractable, respectively, in the radial direction of the annular reject passage to decrease and increase, respectively, the cross-sectional area of the annular reject passage. This is an advantageously simple and cheap solution to enable adjustment of the cross-sectional area of the annular reject passage, when required for the particular type of fiber suspension to be separated. It has surprisingly been shown that an appropriate fine adjustment of the area of the reject passage gives rise to the advantage that non-thickened suspension, instead of escaping past thickened reject fraction, dilutes the latter, thereby facilitating the discharge of the reject fraction through the reject passage.

According to a preferred embodiment of the present invention, the flow restriction means comprise a stationary inner wall portion, which may be secured to the housing, and a stationary outer wall portion, which surrounds the inner wall portion and may be connected to the screen, the annular member, preferably an elastic ring, being secured to the inner wall portion.

As an alternative, the annular member may be secured to the stationary outer wall portion.

The flow restriction means of the present invention may preferably comprise an annular flange provided on the stationary inner wall portion and forming an annular outwardly directed groove, and a resilient tubing positioned in the groove and connectable to a source of pressure for expanding and retracting the tubing, the elastic ring surrounding and abutting the tubing. By means of the source of pressure, a medium in the form of a gas or liquid can be introduced into the tubing to expand the elastic strip to such an extent that the resulted reject passage area is suited for a specific fiber suspension to be treated.

BRIEF DESCRIPTION OF THE DRAWINGS

The present invention is described in more detail in the following detailed description which, in turn, refers to the accompanying drawings, in which.

DETAILED DESCRIPTION

Figure 1:
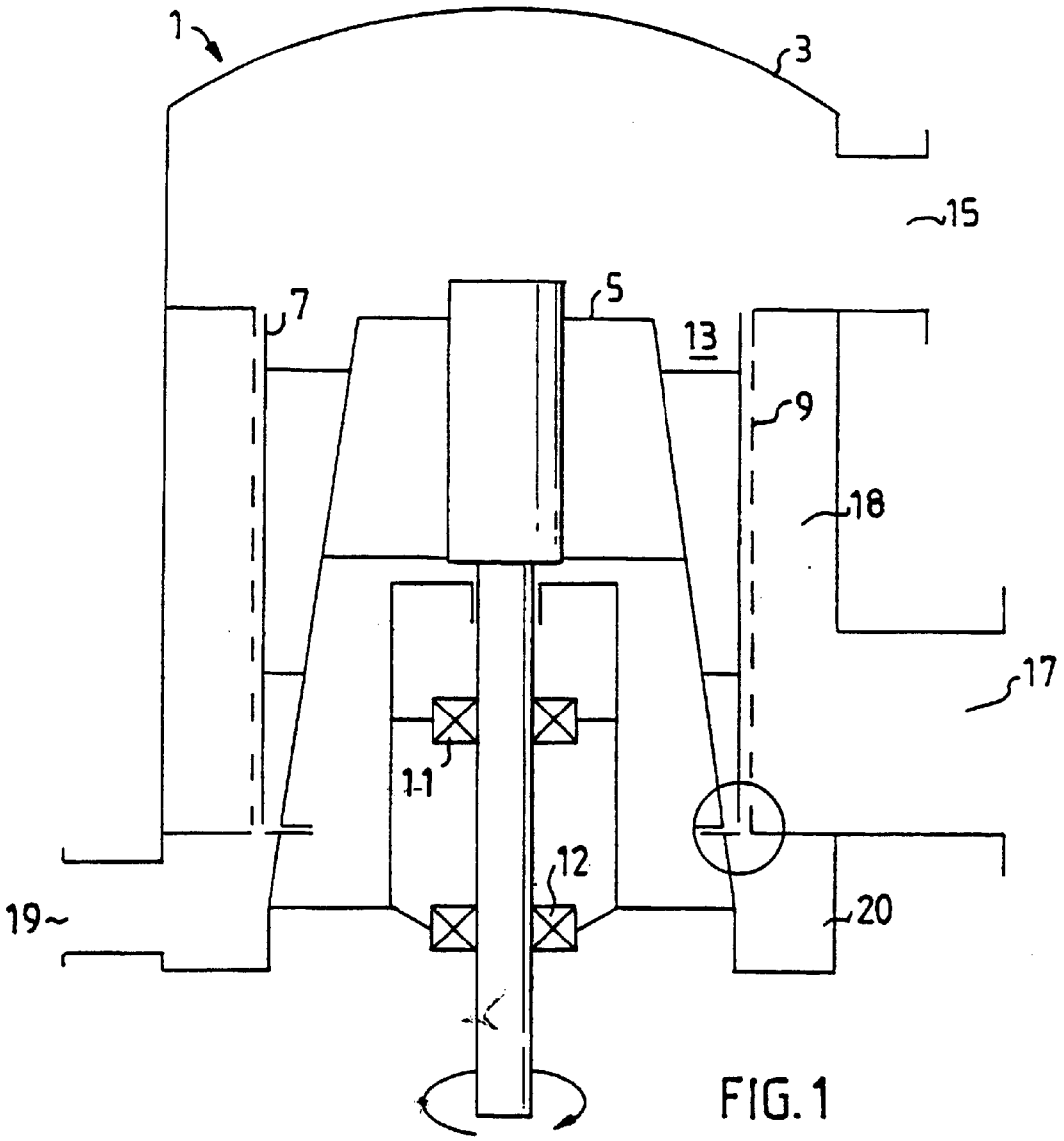
FIG. 1 is a side, elevational, cross-sectional, schematic view of screening apparatus according to a preferred embodiment of the invention.

In FIG. 1 there is shown a screening apparatus 1 of the present invention comprising a generally cylindrical housing 3 with an inlet 15 for a fiber suspension which is to be separated, and a cylindrical screen 9 secured to the housing 3 and dividing the interior of the housing 3 into a central chamber 13 for receiving the fiber suspension from the inlet 15 at one end of the cylindrical screen 9 and a circular outer accept chamber 18 for receiving an accept fraction of the fiber suspension, which has passed through the screen 9. A generally truncated conical rotor 5 provided with a number of circumferentially distributed peripheral wing elements 7 is journalled by bearings, 11 and 12, on the housing 3 and positioned in the central chamber 13 coaxially with the cylindrical screen 9, so that the wing elements 7 sweep past the interior surface of the screen 9, when the rotor 5 is rotated by a drive motor (not shown). The housing 3 is provided with an accept outlet 17 for discharging the accept fraction from chamber 13 and a reject outlet 19 for discharging the developed reject fraction from the interior of the screen 9 through a reject chamber 20 communicating with the central chamber 13.

Figure 2:
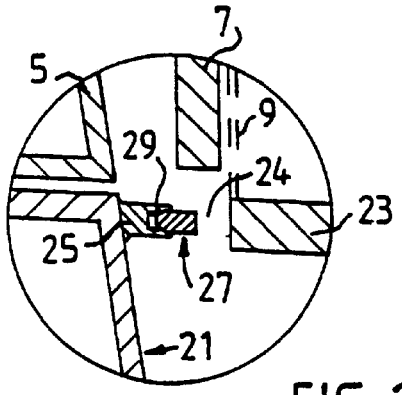
FIG. 2 is a side, elevational, cross-sectional view of the circled detail of the apparatus shown in FIG. 1.

With reference to FIG. 2, a circular reject passage 24, which is coaxial with the screen 9 and situated at the other end thereof, is defined by flow restriction means comprising an inner wall portion 21 secured to the housing 3, an outer wall portion 23 connected to the screen 9 and surrounding the wall portion 21, a circular flange 25 provided on the inner wall portion 21 and forming a circular groove, resilient tubing 29 positioned in the groove, and an elastic ring 27 of a suitable rubber grade surrounding and abutting the tubing 29. The dimension of the ring 27 is chosen such that the ring 27 is received by the groove and is in a prestressed state when the tubing 29 is collapsed. The tubing 29 is connectable to a source of pressure (not shown) for controllably expanding and retracting, respectively, the elastic strip 27 in the radial direction of the circular reject passage 24 to decrease and increase, respectively, the cross-sectional area of the reject passage 24. In the above described embodiment the radial width of the reject passage 24 is variable in the range of about 2 to 25 mm, preferably 10 to 20 mm, by means of the tubing 29 and the elastic ring 27.

In operation, the fiber suspension to be separated is supplied to the central chamber 13 through the inlet 15 and flows along the screen 9 while separating into an accept fraction, which passes through the screen 9 into the accept chamber 18 and discharges therefrom through the accept outlet 17, and a reject fraction, which passes through the reject passage 24 into the reject chamber 20 and discharges therefrom through the reject outlet 19. By pulsating action of the rotating wing elements 7 the screen 9 is prevented from being clogged by fibers and/or contaminants. The source of pressure is controlled such that an appropriate cross-sectional area of the reject passage is achieved by expansion or retraction of the elastic strip 27, which can be verified by analyzing samples of the produced reject fraction. Thus, if the reject samples contains too many fibers that should have been separated with the accept fraction, the strip 27 is gradually expanded until the amount of such fibers in the reject samples has satisfactorily decreased. On the other hand, if the reject flow is insignificant the strip 27 may have to be retracted to increase this flow, in order to avoid detrimental thickening of the reject fraction.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A screening apparatus for separating fiber suspensions comprising a housing including an interior and an inlet for said fiber suspension, a stationary tubular screen having an inlet end adjacent to said inlet and an outlet end, and dividing said interior of said housing into a central chamber for receiving said fiber suspension from said inlet and an outer accept chamber for receiving an accept fraction of said fiber suspension which has passed through said stationary tubular screen, a rotor journalled on said housing for rotation within said central chamber coaxially with said stationary tubular screen, a reject passage for receiving a reject portion of said fiber suspension at said outlet end of said stationary tubular screen, and flow restriction means defining an annular reject passage having a radial width and a cross-sectional area at said outlet end of said stationary tubular screen for discharging said reject portion of said fiber suspension from said central chamber to said reject passage, said flow restriction means comprising an expandable and contractable annular member for decreasing and increasing said cross-sectional area of said annular reject passage.

2. The screening apparatus of claim 1 wherein said flow restriction means comprises a stationary inner wall portion and a stationary outer wall portion surrounding said stationary inner wall portion, said annular member being attached to said stationary inner wall portion.

3. The screening apparatus of claim 2 wherein said stationary outer wall portion is connected to said stationary tubular screen.

4. The screening apparatus of claim 2 wherein said stationary inner wall portion is connected to said housing.

5. The screening apparatus of claim 2 wherein said annular member comprises an elastic ring.

6. The screening apparatus of claim 5 including an annular flange attached to said stationary inner wall portion, said annular flange providing an outwardly facing annular groove, resilient tubing disposed in said annular groove, said resilient tubing being connectable to a source of pressure whereby said resilient tubing can be extended and contracted, and an elastic ring surrounding said resilient tubing.

7. The screening apparatus of claim 6 wherein said elastic ring is received by said annular groove and is in a prestressed state when said resilient tubing is contracted.

8. The screening apparatus of claim 6 wherein said radial width of said annular reject passage can vary between about 2 and 25 mm by means of said expansion and contraction of said resilient tubing.

9. The screening apparatus of claim 8 wherein said radial width of said annular reject passage can vary between about 10 and 20 mm by means of said expansion and contraction of said resilient tubing.

* * * * *

UNITED STATES PATENT AND TRADEMARK OFFICE

CERTIFICATE OF CORRECTION

PATENT NO. : 6,170,769 B1

DATED : January 9, 2001

INVENTOR(S) : Bergdahl et al.

It is certified that error appears in the above-identified patent and that said Letters Patent is hereby corrected as shown below:

On the Title Page,

Item (73) Assignee: "Valmet Fibertech Aktiebolag (CH)" should read --Valmet Fibertech Aktiebolag (SE)--.

Signed and Sealed this

Eighth Day of May, 2001

*Attest:*

Nicholas P. Godici

NICHOLAS P. GODICI

*Attesting Officer*

*Acting Director of the United States Patent and Trademark Office*